US010470583B2

(12) United States Patent
Gross et al.

(10) Patent No.: US 10,470,583 B2
(45) **Date of Patent: *Nov. 12, 2019**

(54) COMPONENT WITH MULTIPLE LAYERS

(71) Applicant: SERTA, INC., Hoffman Estates, IL (US)

(72) Inventors: Andrew Gross, Wilmette, IL (US); Leona Wightman, Huntley, IL (US)

(73) Assignee: SERTA, INC., Hoffman Estates, IL (US)

( * ) Notice: Subject to any disclaimer, the term of this patent is extended or adjusted under 35 U.S.C. 154(b) by 458 days.

This patent is subject to a terminal disclaimer.

(21) Appl. No.: 15/268,934

(22) Filed: Sep. 19, 2016

(65) Prior Publication Data

US 2017/0000265 A1 Jan. 5, 2017

Related U.S. Application Data

(63) Continuation of application No. 13/750,834, filed on Jan. 25, 2013, now Pat. No. 9,538,855.

(51) Int. Cl.

| | |
|---|---|
| ***A47C 27/15*** | (2006.01) |
| ***A47C 21/04*** | (2006.01) |
| ***A47C 27/14*** | (2006.01) |
| ***A47C 27/08*** | (2006.01) |
| ***A47C 27/20*** | (2006.01) |

(52) U.S. Cl.

CPC ..... *A47C 27/15* (2013.01); *A47C 21/046* (2013.01); *A47C 27/085* (2013.01); *A47C 27/088* (2013.01); *A47C 27/148* (2013.01); *A47C 27/20* (2013.01)

(58) Field of Classification Search

CPC ..... A47C 27/15; A47C 27/088; A47C 27/20; A47C 27/085; A47C 27/148; A47C 21/046

USPC ..... 5/740, 655.9, 953

See application file for complete search history.

(56) References Cited

U.S. PATENT DOCUMENTS

| | | | |
|---|---|---|---|
| 2,610,338 | A | 9/1952 | Taylor |
| 3,180,755 | A | 4/1965 | Reinitz |
| 3,512,192 | A | 5/1970 | Simon |
| 3,818,520 | A | 6/1974 | Richards |
| 3,833,951 | A | 9/1974 | Hurwitz |
| 4,092,752 | A | 6/1978 | Dougan |
| 4,504,991 | A | 3/1985 | Klancnik |
| 4,824,719 | A | 4/1989 | Creyf et al. |

(Continued)

FOREIGN PATENT DOCUMENTS

| | | |
|---|---|---|
| CN | 101453925 A | 6/2009 |
| EP | 1421878 A1 | 8/2003 |

(Continued)

OTHER PUBLICATIONS

Christopher Schriever, "Bedroom, Sleep Retailer's Magazine." Summer 2012, pp. 1-36; Washington DC.

(Continued)

*Primary Examiner* — Robert G Santos
*Assistant Examiner* — Myles A Throop
(74) *Attorney, Agent, or Firm* — Cantor Colburn LLP

(57) ABSTRACT

A bedding component includes a top portion having a gel foam, a middle portion having a foam layer with at least one gel disc, and a bottom portion have a foam core.

8 Claims, 8 Drawing Sheets

(56) References Cited

U.S. PATENT DOCUMENTS

| | | | | |
|---|---|---|---|---|
| 5,513,402 | A * | 5/1996 | Schwartz | A47C 23/00 5/691 |
| 5,578,368 | A | 11/1996 | Forsten et al. | |
| 6,718,583 | B1 | 4/2004 | Diaz | |
| 6,954,956 | B1 | 10/2005 | Diaz | |
| 7,424,762 | B2 | 9/2008 | Wright et al. | |
| 7,827,637 | B2 | 11/2010 | Defranks | |
| 8,181,293 | B2 | 5/2012 | Defranks et al. | |
| 8,414,732 | B2 | 4/2013 | Defranks et al. | |
| 8,418,297 | B2 | 4/2013 | Mikkelsen et al. | |
| 8,745,795 | B2 | 6/2014 | Klancnik | |
| 9,538,855 | B2 | 1/2017 | Gross et al. | |
| 2003/0109908 | A1 | 6/2003 | Lachenbruch et al. | |
| 2006/0048301 | A1 | 3/2006 | Klancnik et al. | |
| 2007/0061978 | A1* | 3/2007 | Losio | A47C 21/046 5/655.5 |
| 2007/0226911 | A1 | 10/2007 | Gladney et al. | |
| 2007/0246157 | A1 | 10/2007 | Mason et al. | |
| 2008/0095983 | A1* | 4/2008 | Callsen | A47C 27/085 428/141 |
| 2009/0142551 | A1 | 6/2009 | Fox et al. | |
| 2010/0058541 | A1* | 3/2010 | Kemper | A47C 27/001 5/701 |
| 2011/0256380 | A1 | 10/2011 | Chandler et al. | |
| 2012/0060846 | A1 | 3/2012 | Leoniak et al. | |
| 2012/0066838 | A1 | 3/2012 | Smalling et al. | |
| 2012/0079659 | A1 | 4/2012 | Loos | |
| 2012/0180225 | A1 | 7/2012 | Gladney et al. | |
| 2013/0025065 | A1 | 1/2013 | Chunglo | |
| 2013/0025068 | A1 | 1/2013 | Chunglo | |
| 2013/0025069 | A1 | 1/2013 | Ruehlmann et al. | |
| 2013/0025070 | A1 | 1/2013 | Ruehlmann et al. | |
| 2014/0059776 | A1* | 3/2014 | Romero | A47C 27/15 5/655.9 |
| 2014/0182063 | A1* | 7/2014 | Crawford | C09K 5/14 5/636 |
| 2017/0000265 | A1 | 1/2017 | Gross et al. | |

FOREIGN PATENT DOCUMENTS

| | | | |
|---|---|---|---|
| GB | 2067896 | A | 8/1981 |
| GB | 2157163 | A | 10/1985 |
| JP | 2011244867 | A | 12/2011 |
| WO | 2006028801 | A3 | 3/2006 |

OTHER PUBLICATIONS

Office Action dated Nov. 22, 2018 for CN Application No. 2,839,603 (4 pages).

* cited by examiner

COMPONENT WITH MULTIPLE LAYERS

CROSS REFERENCE TO RELATED APPLICATION

This application is a CONTINUATION of U.S. application Ser. No. 13/750,834, filed Jan. 25, 2013, the contents of which are incorporated herein by reference in its entirety.

BACKGROUND

Mattress with multiple layers are disclosed herein

DESCRIPTION OF THE BACKGROUND OF THE INVENTION

Mattress manufacturers have made significant improvements in mattress comfort in recent decades. Some of the innovations that have contributed to the improvements in comfort are the introduction of foams and layering structures. A primary foam material used in mattress constructions is polyurethane foam.

Foams have numerous characteristics, including density and firmness, that contribute to the "feel" of the mattress. Density refers to the amount of gas-containing cells within a foam matrix. Firmness refers to the rigidity of the matrix, such as polyurethane, itself. Therefore, by varying the density and firmness of a foam, one may provide a mattress having a different "feel." Further, by combining layers of different types of foams, a multitude of different mattresses possessing a broad spectrum of "feel" may be produced. While foam mattresses have achieved broad acceptance for their comfort, they have traditionally had performance issues related to their thermal comfort and support.

Many traditional foams have a closed cell structure. The closed cell structure results in restricted air flow in the mattress and makes the foam a thermal insulator with poor heat transfer characteristics. Consumers complain that the mattresses cause them to be too hot while sleeping. Another problem with traditional foam mattresses is the support provided to an individual on the mattress. Many foams are not able to conform well to the curves of an individual's body and provide poor support by focusing the individual's weight on a couple of points on the foam rather than along the entire length of the foam adjacent to the individual's body. This is due to a phenomenon referred to as "bottoming out" where the individual's weight on the foam compacts the foam to a point where resilience is lost. Typical foams bottom out and exhibit a hard "feel" as they are compacted by the weight of an individual's body.

In light of the above, there exists a need for an improvement in the materials and methods used for manufacturing mattresses to provide greater thermal comfort and progressive support. Incorporation of new materials into mattresses that improve air flow and cooling through better heat dissipation is desirable. Moreover, the use of materials that simultaneously improve heat dissipation while providing better progressive support would provide a marked improvement in the bedding industry.

SUMMARY OF THE INVENTION

According to one aspect of the present disclosure, a component includes a first high thermal conductivity foam layer and a second foam layer having at least one gel portion.

According to another aspect of the present disclosure, a bedding component includes a top portion having a gel foam, a middle portion having a foam layer with at least one gel disc, and a bottom portion having a foam core.

According to a further aspect of the present disclosure, a mattress includes a bilayer foam topper. The bilayer topper includes a top layer having a high thermal conductivity foam and a bottom layer with foam. The mattress further includes a high thermal conductivity dual foam layer disposed below the bilayer foam topper. The dual foam contains a phase change material. The mattress further includes a foam layer disposed beneath the high thermal conductivity dual foam layer. The foam layer includes a plurality of gel discs. The mattress also includes a core layer disposed beneath the foam layer that includes at least one of a foam core, a gel foam core, a latex core, an inner spring layer, a layer of individually wrapped coils, an air inflated system, and a liquid system.

DETAILED DESCRIPTION

The present disclosure relates to layered components, such as a bedding component, including mattresses, cushions, pillows, mattress supports, such as box springs, pads, mats, and the like. Components of the present disclosure may be constructed of multiple layers as described hereinbelow to provide a desired effect, such as a firm feel, a heat dissipating feel, a soft feel, and the like, to a user resting on a top surface thereof. In a preferred embodiment, the layered components include a gel foam placed therein or thereon.

The contemplated components may be part of a conventional item of furniture, such as a bed equipped with a bed frame. In this scenario, the component may be a mattress that is placed upon the bed frame, perhaps atop of a box spring or other mattress support. As an alternative, the component may form an integral part of an item of furniture. For example, the component may be in the form of a padded sleeping surface of a foldable cot, wherein the sleeping surface incorporates one or more structural components of a support frame of the cot. In this way, the sleeping surface is affixed to the support frame of the cot. In other examples, the component may be a cushion of a chair or a couch, a throw pillow, a pet pillow, a portion of a car seat, or any other padded surface.

Components may be of any desired size according to the intended use. In the context of mattresses, a mattress may have a length of about 73 to about 82 inches and a width of about 37 to about 75 inches. However, a mattress may be shorter or longer. Indeed, many mattresses may be manufactured to conform to standard size conventions, such as, a crib mattress size, a twin bed size, a twin XL size, a full bed size, a full XL size, a queen bed size, a king bed size, and a California king size.

Figure 1:
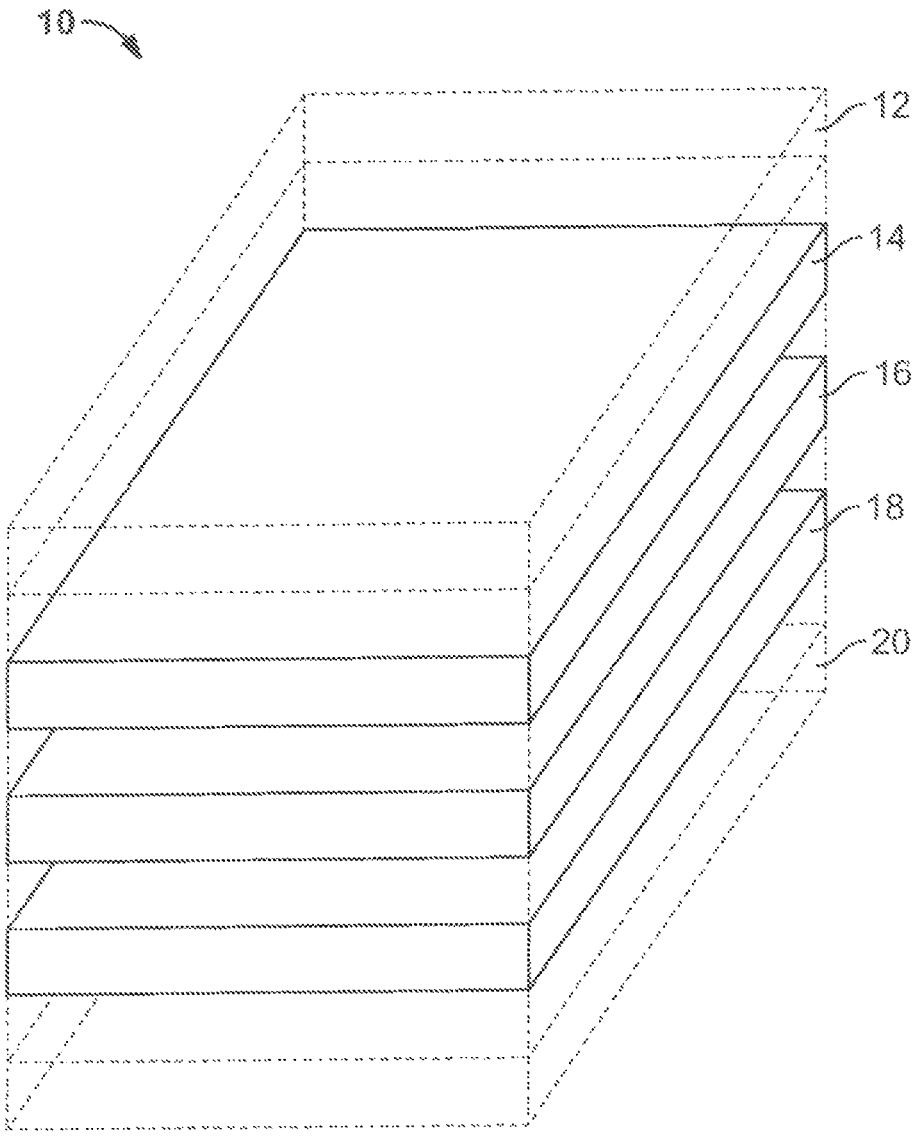
FIG. 1 is an exploded isometric view of a component having multiple layers.

In one embodiment depicted in FIG. 1, a contemplated component 10 comprises an optional top portion 12, an upper intermediate portion 14, a middle portion 16, a lower intermediate portion 18, and an optional bottom portion 20. The top portion 12 and bottom portion 20 may each be comprised of x+m layers, wherein x=0, and m=0-infinity, and wherein each of x+m layers is affixed to any adjacent layer on a top surface and/or a bottom surface thereof. For example, top portion 12 or bottom portion 20 may include 0 layers, or 1-6 layers, or 2-8 layers, or 3-12 layers, or 4-20 layers. The upper intermediate portion 14, middle portion 16 and lower intermediate portion 18 may each be comprised of y+n layers, wherein y=0, and n=1-infinity, and wherein each of y+n layers is affixed to any adjacent layer on a top surface and/or a bottom surface thereof. For example, upper intermediate portion 14, middle portion 16 or lower intermediate portion 18 may each include 1-6 layers, or 2-8 layers, or 3-12 layers, or 4-20 layers. However, the sum of all the layers of the component is greater than or equal to 3, i.e., $2(x+m)+3(y+n)\geq 3$, and more preferably the sum of all layers is between 3 and 20. The layers disclosed herein may be arranged, for example, stacked, in any order relative to one another.

Layers may be affixed by any suitable means known in the art. Layers may be sprayed-on, injection molded, extruded, coextruded, laminated, and the like. In several preferred embodiments, layers may be stapled, tacked, welded, laminated, mechanically affixed via friction or interference fit, adhered via an adhesive, a glue, a cement, or other material with adhesive properties, stitched, affixed via hook and loop fastener, a zipper, a Dennison-style tag, snaps, and/or other reversible means, and combinations thereof.

Component layers may be of any thickness. For example, in several preferred embodiments, the component layer is less than or about ½ inch, less than or about 1 inch, less than or about 2 inches, less than or about 3 inches, less than or about 4 inches, less than or about 5 inches, less than or about 6 inches, less than or about 8 inches, or less than or about 12 inches, and all thicknesses in between. Component layers may also be of varying widths and lengths that are not necessarily tied to the size of the component. For example, a mattress may include a first layer with a first width and a second layer with a second width, where the first width is wider or narrower than the second width. When a layer is wider than the component, it may be folded in upon itself or folded upwardly or downwardly along the side of the component to form a portion of a sidewall of the component. Similar variability with respect to layer length is also possible.

Layers may include a fabric, a natural fiber, a synthetic fiber, a ticking layer, a quilt layer, a thread layer, a film, a foam, a gel, a gel foam, a multi gel foam, a high thermal conductivity foam, a woven layer, a nonwoven layer, a fire-resistant layer, a non-skid layer, and combinations thereof. A component core layer may be any mattress core construction including a foam core, a gel foam core, a latex core, an inner spring layer, a layer of individually wrapped coils, an inflated air system, or a liquid system, e.g., water.

In another embodiment, a layer may further include an adhesive. Adhesives that may be used in the present disclosure include any adherent materials or fasteners known in the art. Specific examples of adhesives include hot melt, water-based, and pressure-sensitive adhesives, fire-resistant adhesives, and mixtures thereof. Hot melt adhesives that may be used include those available from Henkel (Rocky Hill, Conn.) and UPACO brand adhesives available from Worthen Industries (Nashua, N.H.). Water-based adhesives that may be used include water-based adhesives under the SIMALFA brand available from Alfa Adhesives, Inc. (Hawthorne, N.J.). Further, a layer may further include a silica, a metallic layer, a plastic, such as an acrylic, a modacrylic, a polyolefin, a latex, a polyurethane, and combinations and/or blends thereof. In addition, a layer may further include biocides, preservatives, odor blocking agents, scents, pigments, dyes, stain guards, antistatic agents, antisoiling agents, water-proofing agents, moisture wicking agents, and the like, as are known in the art.

One particular material contemplated herein is foam, such as a polyurethane or latex-containing foam. Foams contemplated herein may vary by density, firmness, as may be measured by indentation force deflection (IFD) or other suitable metrics, and thickness, among other characteristics. Extremely firm foams or gels may be measured by compression force deflection (CFD) as an alternative to IFD. The characteristics of a foam layer may be chosen based on whether the layer is to be placed within the top portion 12, the upper intermediate portion 14, the middle portion 16, the lower intermediate portion 18, or bottom portion 20 of the component (see FIG. 1). A foam to be used in the top portion 12 of a component, such as a mattress, may be less firm to provide a more comfortable feel than a foam used in the middle portion 16, which provides a relatively more rigid support for the top portion. Foams may have a density of about 1 to about 5 $lbs/ft^3$ or about 2 to about 4 $lbs/ft^3$. With respect to firmness, contemplated foams used herein may have an IFD of between about 1 to about 100 lbs, or about 2 to about 60 lbs, or about 6 to about 36 lbs, or about 12 to about 52 lbs, or about 20 to about 80 lbs. Foam layers may be monolithic or formed from multiple pieces of a single foam material or of different foam materials affixed to one another, as described herein.

Another particular material contemplated herein is a gel foam. Gel foams include a solid three-dimensional molecular network that comprises a substantially cross-linked system of particles distributed in a gelatinous matrix of any form, shape, or size which exhibits no, or substantially no, flow when at steady-state. Gel foams are a binary system of dissimilar materials in which the continuous phase may be a polyurethane foam or a similar suitable material, and one or more gels is infused or integrated into the continuous phase as discrete particles, beads or other shapes, thereby modifying the support factor, thermal capacitance, and/or thermal conductance characteristics of the layer. Therefore, gel foams have defined and sustainable shapes supported by a continuous three-dimensional network of cross-linked particles. These discrete gel particles or articles can have physical properties such as feel ranging from soft-to-hard and such as durability ranging from weak-to-tough. In this way, heat dissipation capacity and additional comfort may be incorporated into a component of the present disclosure.

Contemplated gel foams may or may not be memory foams, which include memory gel foams and/or latex gel foams. A memory foam exhibits a slow return to its original form once compacted by a weight. Further, memory foams are activated by the temperature of a user's body, in that, memory foams soften where they come in contact with a user's body and thereby more easily conform to the user's body curves. One type of a memory foam is a slow response latex foam.

Yet another material contemplated herein is a high thermal conductivity foam. Thermal conductivity is the time rate of steady heat flow through a unit area of a homogeneous material induced by a unit temperature gradient in a direction perpendicular to that unit area. Standard foams have low thermal conductivities of less than 0.030 BTU/(ft-hr-degF), whereas high thermal conductivity foam has a thermal conductivity that is greater than or equal to 0.031 BTU/(ft-hr-degF), when measured by ASTM E-1225 standards. High thermal conductivity foams consist of a flexible polymeric carrier and thermally conductive material. The flexible polymeric carrier material may be selected from any number of suitable materials, e.g., polyurethane, latex, natural rubber, synthetic rubber, etc. The thermally conductive material may consist of any material that can be added to the flexible polymeric carrier material to increase the thermal capacitance and/or thermal conductance characteristics, e.g., gels, carbon black, graphite, carbon nanotubes, aluminum oxide, calcium carbonate, metallic flakes, etc. Gel foams as described above can be modified to become high thermal conductivity foam by adding gels specifically formulated with high thermally conductive properties as noted above. One such gel may contain phase change material. Gel containing phase change material stores heat if the solid phase change material changes to a liquid, whereupon it is released when the liquid phase changes to a solid.

Figure 2:
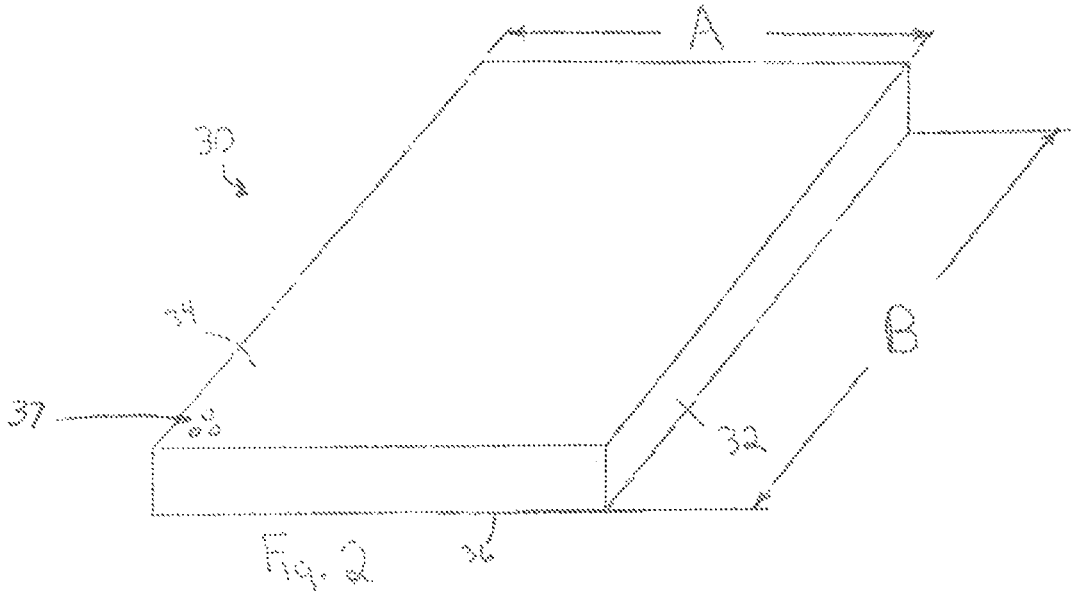
FIG. 2 is an isometric view of a foam layer according to one embodiment.
Figure 3:
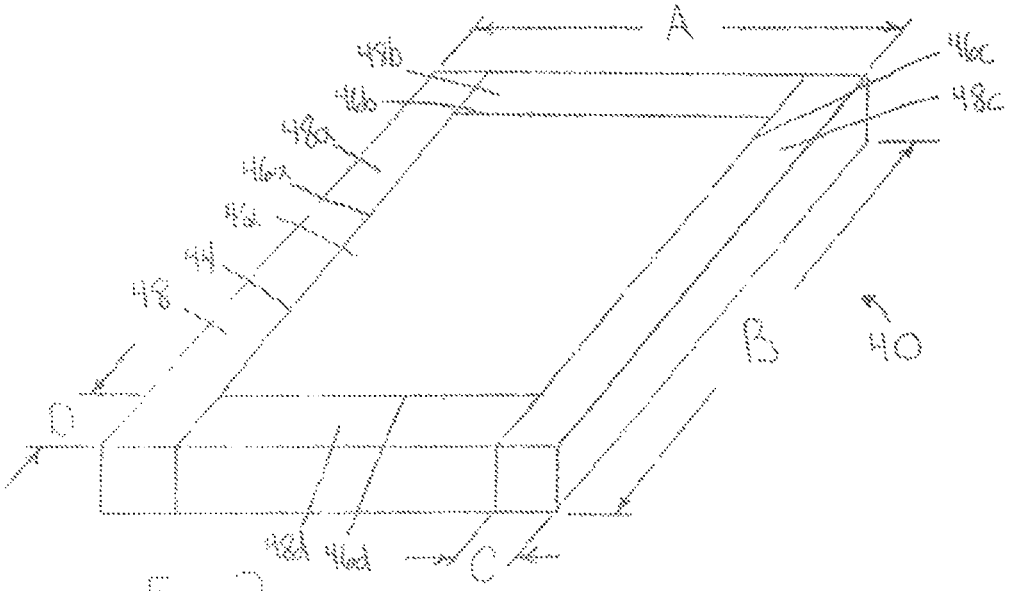
FIG. 3 is an isometric view of another foam layer.
Figure 4:
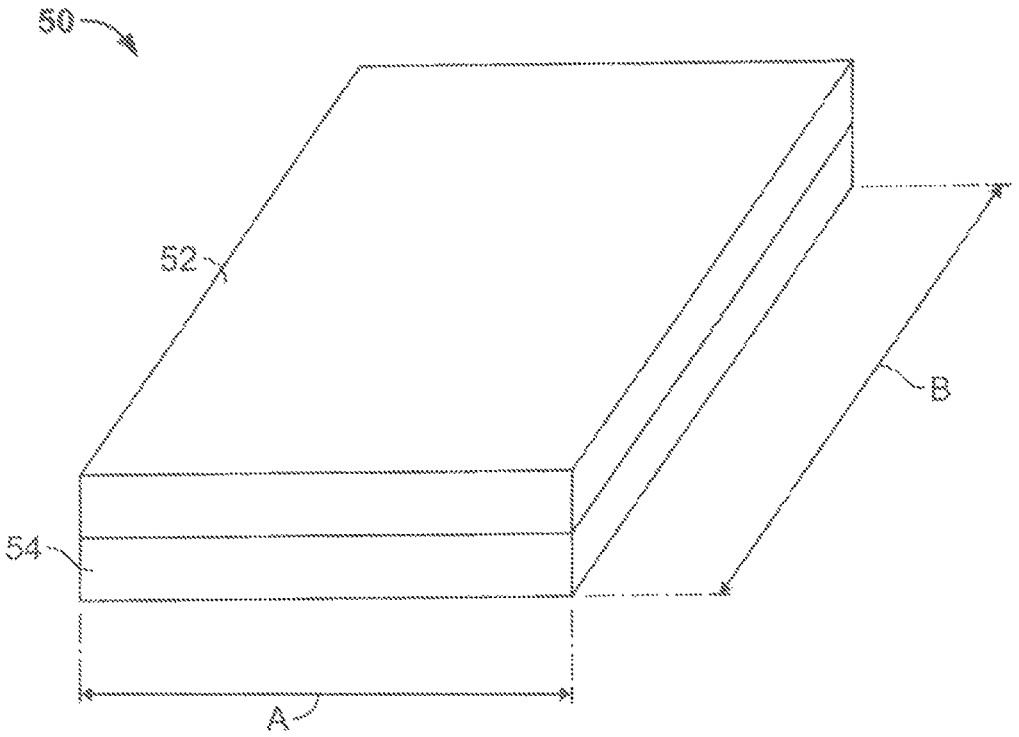
FIG. 4 is an isometric view of a different foam layer.

Layers, such as foam layers, may be monolithic or may include multiple portions of the same or different materials affixed together, as shown in FIGS. 2, 3, and 4. With reference to FIG. 2, one embodiment of a layer 30 is shown. In the present embodiment, layer 30 is a foam layer that includes a single portion 32 with a top surface 34 and a bottom surface 36. The layer 30 may be modified to change the support and/or thermal properties thereof. In one preferred embodiment the layer 30 may have a matrix of holes extending therethrough (not shown). In a particular embodiment, the holes are vertically aligned and extend from a top surface 34 of layer 30 to the bottom surface 36 thereof to increase airflow and reduce firmness of the layer. In the present embodiment, the holes are about 15 mm in diameter, however, the holes may be smaller or larger depending on preferences related to airflow and firmness. Similarly, the holes may be oriented in a vertical, horizontal, or oblique direction, or a combination thereof, as desired to provide the specific airflow and firmness profiles desired.

Turning to FIG. 3, a layer 40 is depicted that comprises a foam layer. In the present embodiment, the foam layer 40 includes an inner portion 42 affixed along a peripheral side surface 44 to side surfaces 46*a-d* of an outer portion 48. In one particular embodiment, the outer portion 48 comprises discrete outer portions 48*a-d*. For purposes of affixation, the inner portion 42 and outer portions 48*a-d* may be affixed as any other layer herein. In the embodiment shown in FIG. 3, the outer portion 48 surrounds the inner portion 42 and has a width C along length B of the layer 40 and a width D along width A of the layer 40. The widths C and D may be the same or may differ from one another. Accordingly, widths C and D may each independently be about ½ inch to about 10 inches, or about 1 inch to about 8 inches, or about 2 inches to about 6 inches.

In addition to the embodiment depicted in FIG. 3, alternative embodiments are contemplated where fewer outer portions border the inner portion 42, for example, along 1, 2 or 3 sides. Further, in still other embodiments, the outer portions 48*a-d* may comprise a unitary structure or more or less than the four previously mentioned discrete portions. Moreover, the inner portion 42 and outer portions 48*a-d* may be made of the same or a different material and may have the same or different density and/or firmness values, in the case of a foam material. In this way, the outer portions 48*a-d* may provide additional structural support to the layer 40. For example, in the context of a foam, the inner portion 42 may have a density of about 1.5 lbs/ft$^3$ and an IFD of about 28 to about 33 lbs, while the outer portion 48*a-d* may have a density of about 1.45 lbs/ft$^3$ and an IFD of about 40 to about 45 lbs. Additional variations in density and/or firmness are contemplated including where the inner portion 42 has a greater firmness compared to the outer portion 48*a-d*.

With reference to FIG. 4, a layer 50 is shown that comprises a different type of foam layer. In the present embodiment, the foam layer 50 includes a top layer 52 affixed to a top surface of a bottom layer 54. The top layer 52 and the bottom layer 54 may have the same thickness or have a different thickness relative to the other layer, as desired. Top layer 52 and bottom layer 54 may also be made of the same or a different foam material that may differ in density and/or firmness. In this way, the bottom layer 54 may have a greater density and/or firmness to provide additional structural support to the foam layer 50. For example, the top layer 52 may have a density of about 3 to about 3.4 lbs/ft$^3$ and an IFD of about 6.5 to about 8.5 lbs, while the bottom layer 54 has a density of about 1.2 to about 1.35 lbs/ft$^3$ and an IFD of about 15 to about 20 lbs. Additional variations in density and/or firmness are contemplated, including where the top layer 52 has a greater firmness compared to the bottom layer 54. Additionally, one or both of the top layer 52 or the bottom layer 54 may be a high thermal conductivity layer. As an additional alternative to the embodiment shown in FIG. 4, either one of the top layer 52 or the bottom layer 54 may have a different dimension in width A and/or in length B relative to the other. It is contemplated that all foam layers herein may be high thermal conductivity foams or high thermal conductivity gel foams, for example, layers 30, 40, and 50 herein.

As another alternative, the attributes of the embodiments depicted in FIGS. 3 and 4 may be combined. For example, the foam layer of FIG. 4 may have inner and outer portions analogous to the inner portion 42 and the outer portions 48*a-d* of FIG. 3, of which one or both of the portions 42 and 48*a-d* may have a top layer and a bottom layer analogous to the top layer 52 and the bottom layer 54 of FIG. 4. Each of the aforementioned layers and portions may be the same material, different materials, or mixtures thereof.

In a further embodiment, the lines 44 and 46*a-d* may demarcate different materials included in the layer 40, such as different foams. These lines of demarcation may indicate affixation points of separate materials or gradient changes from one material to another of a single portion.

Figure 5:
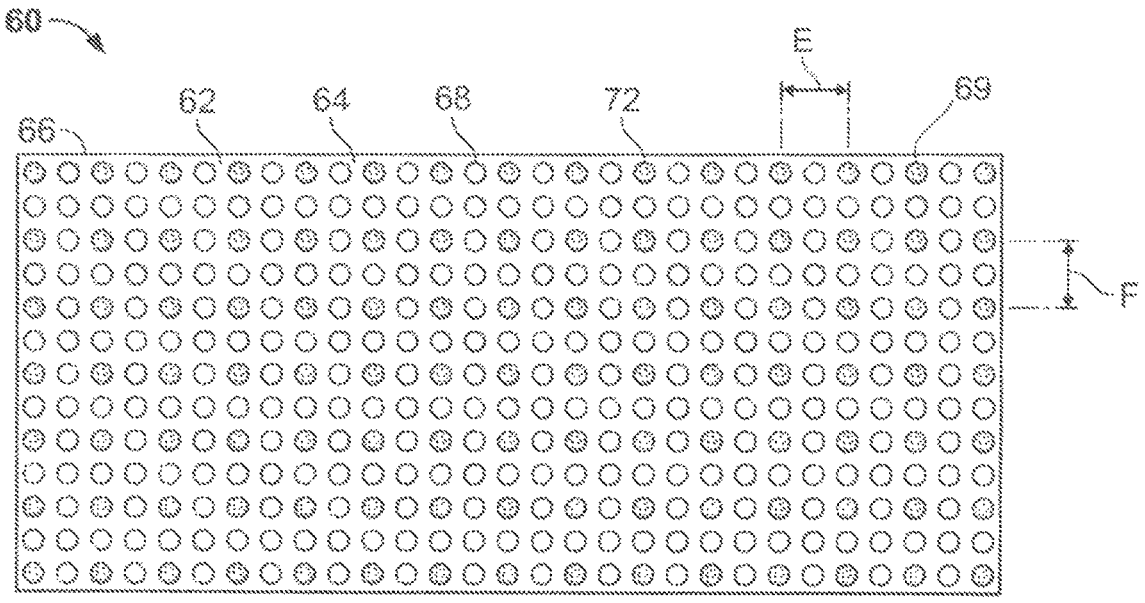
FIG. 5 is a top plan view of a foam layer according to yet another embodiment.

Turning to FIG. 5, a layer 60 (otherwise referred to as a component) is shown that comprises a foam layer 62 with top and bottom surfaces 64, 66, respectively. The layer 62 includes a matrix of depressions 68 provided within the top surface 64. In a different embodiment, the matrix of depressions 68 may be provided on the bottom surface 66 or a combination of the top and bottom surfaces 64, 66. In the present embodiment, the matrix of depressions 68 substantially covers the top surface 64 of the layer 62. While depicted as generally circular, the depressions 68 may comprise any shape with respect to one another and/or about the length thereof extending from the top surface 64 to a distal interior portion of each depression.

One or more of the depressions 68 is provided with a gel disposed therein to assist in providing a desired support profile. In the present embodiment, about twenty-five percent of the depressions 68 in the top surface 64 are filled with a gel. The gel may be generally referred to as a gel portion or gel disc 72 that comprises a discrete portion of gel that may have any shape or form and may be provided in physical contact with one or more surfaces defining the depressions 68 and/or may be placed within a packet or other reservoir or holding means, e.g., a plastic sheath or capsule. In a preferred embodiment, the gel is poured or otherwise directly provided into the depressions 68, whereupon gel discs 72 are formed with a volume and/or surface area to effect the desired support profile. In the present embodiment, the gel discs 72 are generally circular and are about two inches in diameter and about a quarter inch thick. The number of depressions 68 filled with the gel discs 72 may vary depending on the desired support profile, and may range from 1 depression to all of the depressions, or 10% of the depressions to 90% of the depressions, or 25% of the depressions to 75% of the depressions, or any range therebetween.

Figure 5A:
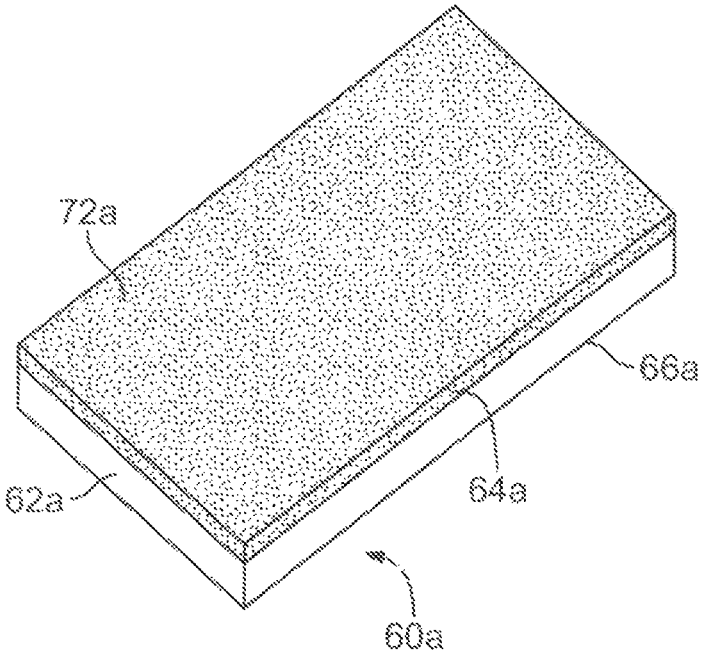
FIG. 5A is an isometric view of an alternative embodiment of the foam layer of FIG. 5.
Figure 5B:
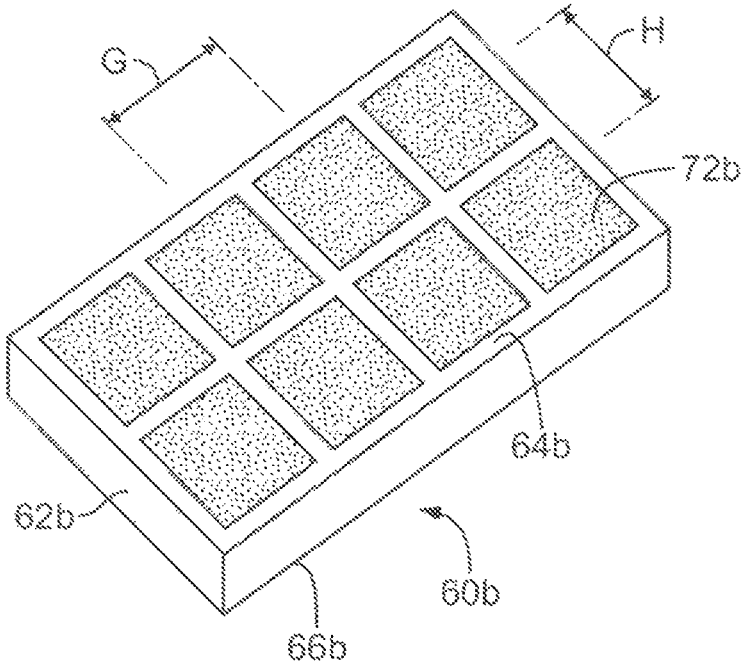
FIG. 5B is an isometric view of another embodiment of the foam layer of FIG. 5.

With reference to FIGS. 5A and 5B, two alternative embodiments of component 60 are depicted as components 60*a* and 60*b*, respectively. The component 60*a* comprises a single gel disc 72*a* or layer that extends across the entirety of the top surface 64*a*. The component 60*b* includes several discrete gel discs 72*b* or layers separated by areas devoid of any gel disc or layer. The dimensions G and H illustrated in FIG. 5B represent length and width dimensions, respectively, between central portions of adjacent gel discs or layers 72, and may comprise any distance that provides the desired support profile. For example, where G has a distance of X and H has a distance of Y, the ratio of X/Y may be about 1/16, about 1/8, about 1/4, about 1/2, about 1, about 2, about 4, about 8, about 16 for any distance X, Y, and the like. It is also envisioned that any number of shapes, sizes, and physical arrangements of the gel disc(s) or layer(s) 72 may be utilized. More specifically, the provision of the component 60, 60*a*, 60*b* provides for progressive support.

With particular reference to FIG. 5, it is shown that the gel discs 72 are spaced from one another by a distance E and F about the top surface 64 of layer 60. Dimensions E and F may be any value that provides for the desired support profile. In a preferred embodiment, the gel discs have a diameter of two inches and are spaced a distance E of about 5.25 inches and a distance F of about 5.5 inches. Here, the foam 62 may be monolithic and have a thickness of less than or about 2 inches. The foam layer 62 may have a density of about 1.2 lbs/ft$^3$ and an IFD of about 15 to about 21 lbs. The gel comprises a standard hydrocarbon gel with a CFD of about 4 to about 6 psi and a density of about 50 to about 60 lbs/ft$^3$. The gel may comprise any number of materials known to those with skill in the art and may have any CFD to provide the specific support profile required.

As another alternative, the attributes of the embodiments depicted in FIGS. 3, 4, and 5 may be combined. For example, a foam layer may have inner and outer portions analogous to inner portion 42 and outer portions 48*a-d* of FIG. 3, of which one or both of the portions 42 and 48*a-d* may have a top layer and a bottom layer analogous to the top layer 52 and the bottom layer 54 of FIG. 4. One or both of the top layer 52 and the bottom layer 54 may have a matrix of circular depressions 68 with one or more of them filled with gel discs 72 as shown in layer 62. Each of the aforementioned layers and portions may be the same material, different materials, or mixtures thereof.

Figure 6:
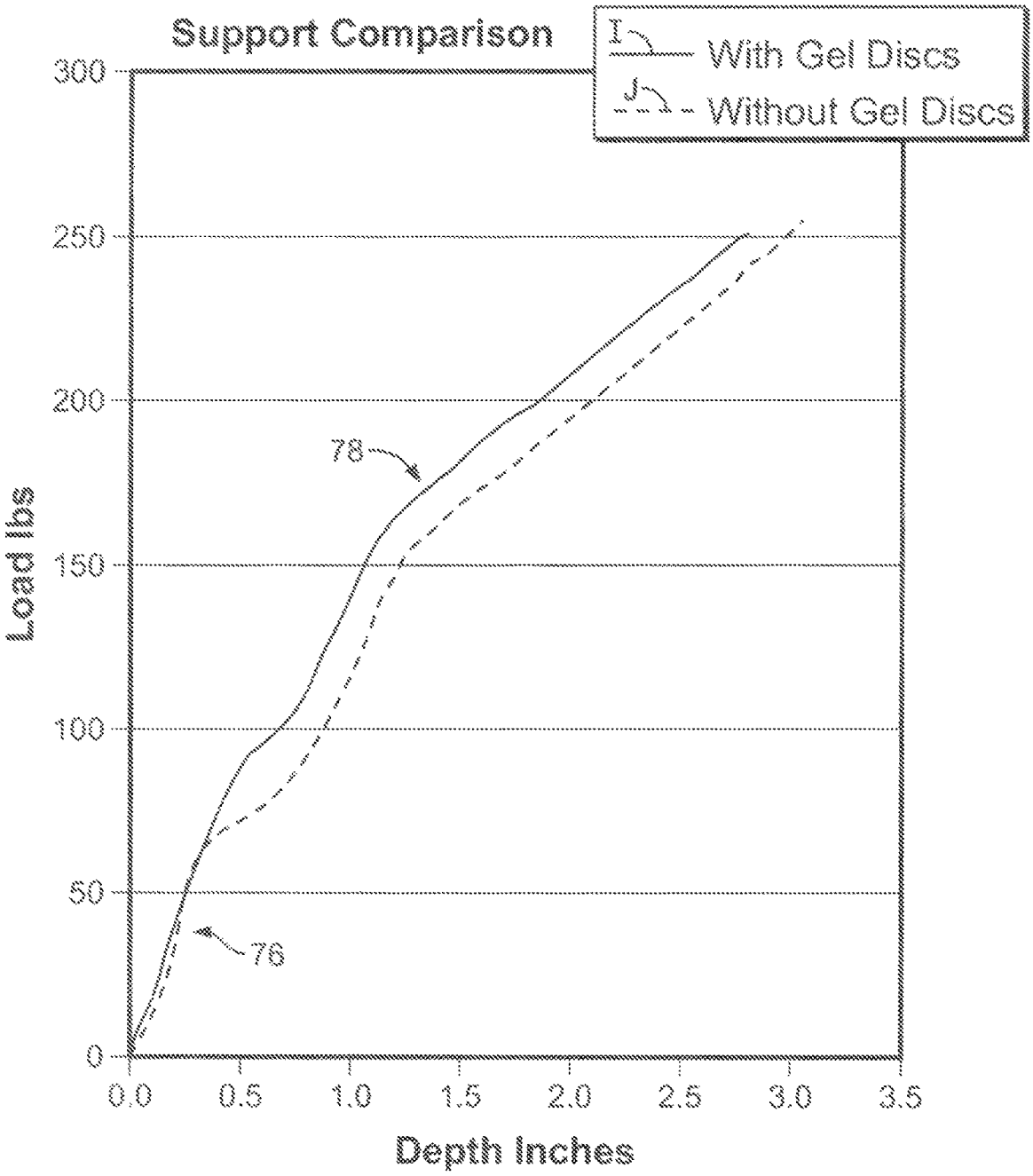
FIG. 6 is a chart depicting a comparison of the support profile of two foam layers.

With reference to FIG. 6, a chart is provided that illustrates how the gel discs 72 in component 60 change the support profile thereof to be substantially more progressive. Progressive support may be generally described as when the amount of force required to compress the foam to a greater extent changes as the amount of compression increases. Turning again to FIG. 6, the solid line I represents the foam component 60 (see FIG. 5) undergoing a standard force compression test with a 13.5 inch platen. The dashed line J represents a foam layer identical to component 60 without any depressions 66 or gel discs 72. A region 76 in FIG. 6 demonstrates that at small amounts of compression, i.e., less than about 0.4 inches, the foam layers with and without gel discs require the same amount of force to compress the component. As the amount of compression is increased beyond about 0.4 inches, the lines I and J diverge from one another and the slopes of the lines change. It can be seen from a comparison of lines I and J that the addition of the gel discs 72 necessitates a greater force requirement to achieve the same compression of the component. Therefore, the gel discs 72 improve the progressive support profile of component 60 when compared to the same foam layer without the gel discs 72. Progressive support is important to users to prevent the "bottoming out feeling" one gets when foam is over compressed at points along a body resting on a component.

Figure 7:
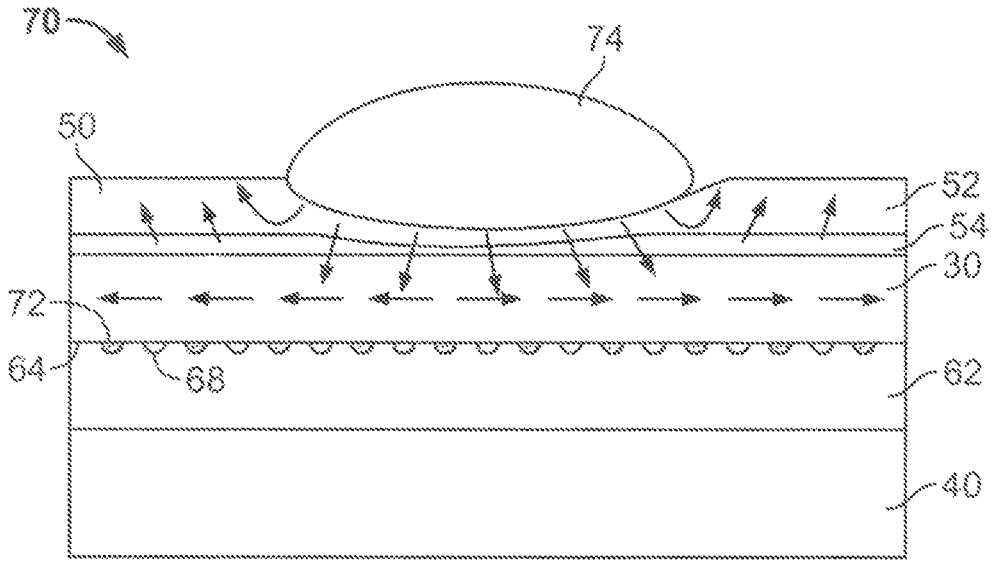
FIG. 7 is a schematic cross-sectional view of a component having multiple layers showing a heat transfer path according to one embodiment.

However, adequate support is not the only concern that user's have in connection with such components. Another concern is how heat from a body of a user on a component is distributed throughout the component. Turning now to FIG. 7, a schematic representation of a component 70 having multiple layers is shown with one possible heat transfer path. Particularly, the component 70 may be a mattress with a heat source 74, such as a human body, that is resting on a compression layer. In the present embodiment, the compression layer comprises the foam layer 50 as noted above (see FIG. 4), which is a bilayer foam with the top layer 52 consisting of high thermal conductivity foam and the bottom layer 54 consisting of standard foam. The physical contact of the human body 74 with the compression layer 50 provides for the introduction of heat via convection into the component 70. Layer 30 (see FIG. 2) consists of a high thermal conductivity foam and is provided below layer 54 and above the layer 62, which is similar to component 60 of FIG. 5. The layer 62 includes a matrix of circular depressions 68, of which about 25% are filled with gel discs 72 located in the surface 64. Layer 40 is a high IFD foam core similar in structure to layer 40 of FIG. 3. The layers 52 and 54 are soft to provide a "pillow top" like feeling to the body 74 and to allow the foam to conform to the shape of the body 74. Layer 52 transfers heat to the layer 30, which is firmer and a better conductor of heat away from the area that body 74 is compressing. The combination of different firmness layers with high thermal conductivities allows for the body 74 to be properly supported along the entire length of the component 70 without excessive and uncomfortable heating. The layer 62 with gel discs 72 improves the overall progressive support profile of the high thermal conductivity layers 52 and 30. By combining the thermal advantages of multiple high thermal conductivity foam layers and the progressive support profile of the foam layer with gel discs, it is possible to produce a mattress or other component that meets the temperature and support profile desired by users.

Figure 8:
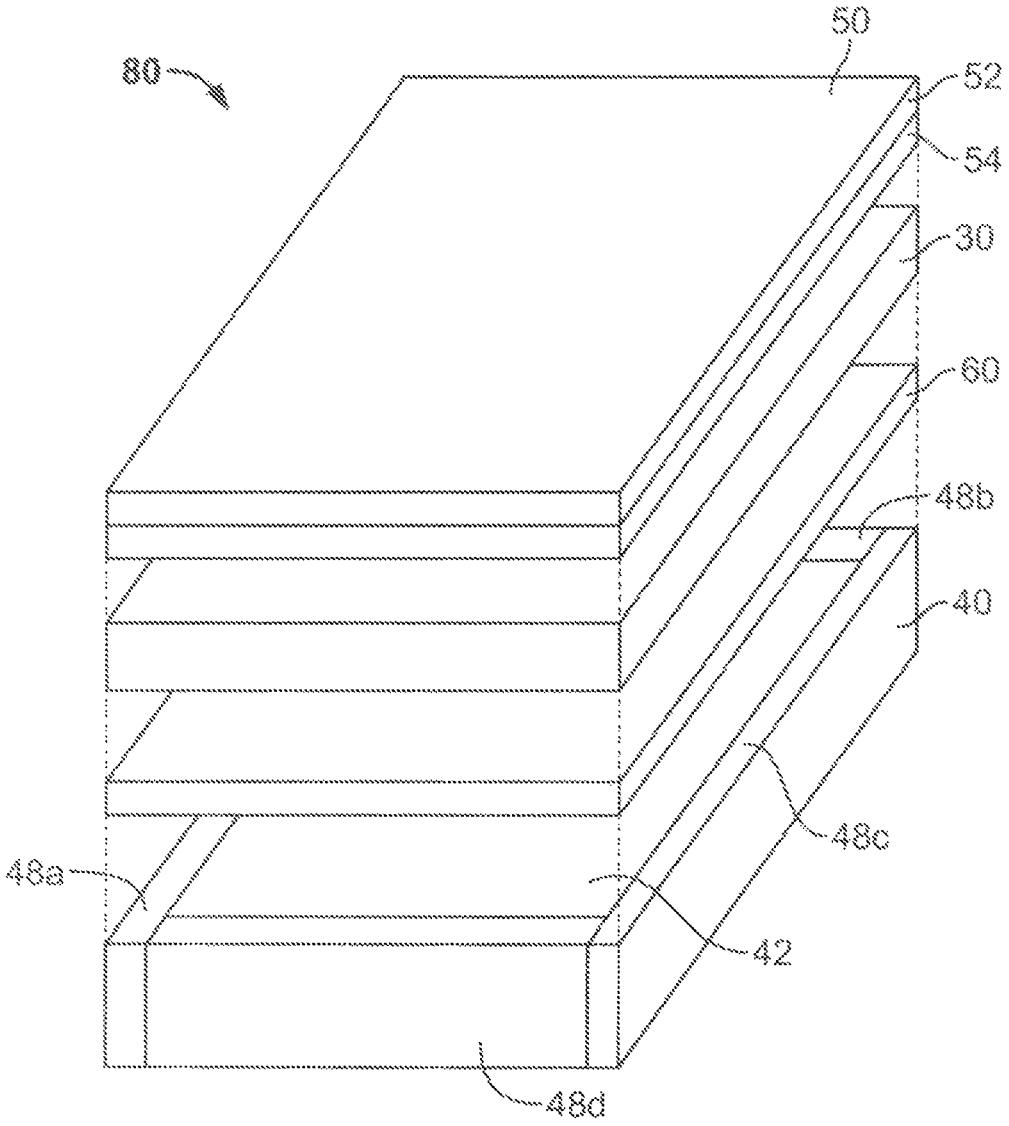
FIG. 8 is an exploded isometric view of a component having multiple layers according to a further embodiment.

FIG. 8 illustrates a preferred embodiment of a layered component 80 that includes the foam core 40 with the inner portion 42 and the outer portions 48*a-d*. Layer 60 comprises a monolithic foam core about 1 inch thick with circular gel discs as previously described in connection with the component 60 shown in FIG. 5, which provides for progressive support. Layer 30 is a monolithic, high thermal conductivity, dual gel foam. The dual gel foam of layer 30 is provided with phase change material, and together comprise between about 35 to 37 percent by volume of the layer 30. The layer 30 is about 2 inches thick with a density of about 4.0 to 4.5 lbs/ft$^3$ and an IFD of about 8 to about 11 lbs. The thermal conductivity of layer 30 is about 0.042 BTU/(ft-hr-degF). Layer 50 comprises a top portion 52 that is a high thermal conductivity foam about 2 inches thick and a bottom portion 54 comprising standard foam about 1 inch thick. Layer 52 consists of foam with a density of about 3.0 to about 3.4 lbs/ft$^3$, an IFD of about 6.5 to about 6.8 lbs, and a thermal conductivity of about 0.035 BTU/(ft-hr-degF). The layer 52 also contains about 15 percent by volume of graphene. Layer 54 is a foam with a density of about 1.2 to about 1.4 lbs/ft$^3$ an IFD of about 15 to about 20 lbs.

Figure 9:
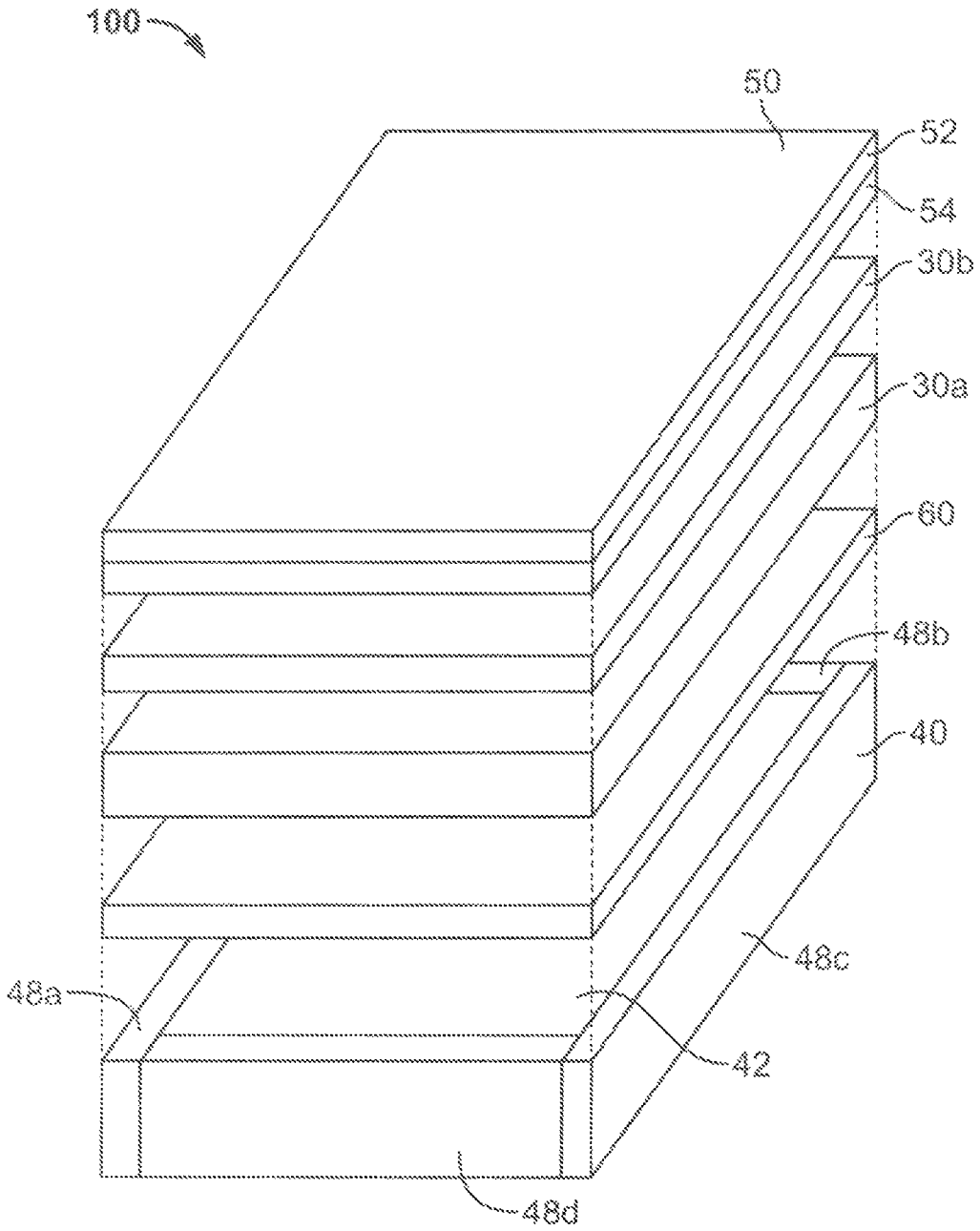
FIG. 9 is an exploded isometric view of a component having multiple layers according to yet another embodiment.

In a further embodiment shown in FIG. 9, a component 100 includes a foam core 40 with an inner portion 42 and outer portions 48*a-d*. Affixed to the top of foam core 40 is a foam gel disc layer 60. Layer 60 comprises a monolithic foam core about 1 inch thick with circular gel discs as previously described in connection with the component 60 shown in FIG. 5, which provides for progressive support. Layer 30*a* is a high thermal conductivity dual gel foam with phase change material as previously described in connection with layer 30 of FIG. 8. Attached to the top of layer 30*a* is a layer 30*b*. Layer 30*b* is a latex foam that consists of either a gel latex foam with about 9 percent gel or a slow response latex foam. The gel latex foam has a density of about 4.4 to about 5.8 lbs/ft$^3$ and an IFD of about 20 to about 25 lbs and is about 0.4 inches thick. The slow response latex foam has a matrix of vertical holes for increased airflow. The holes are about 15 mm in diameter and the foam has a density of about 5 lbs/ft$^3$. The top layer of component 100 is a bilayer foam as previously described in connection with the layer 50 of FIG. 8, which includes a high thermal conductivity foam layer 52 and a standard foam layer 54.

The embodiments described in FIGS. 8 and 9 are illustrative of preferred examples of layered components that provide improved thermal and support profiles for a variety of customer desires.

INDUSTRIAL APPLICATION

The components disclosed herein provide improvements in comfort for mattresses and other cushioned furniture. The disclosure has been presented in an illustrative manner in order to enable a person of ordinary skill in the art to make and use the disclosure, and the terminology used is intended to be in the nature of description rather than of limitation. It is understood that the disclosure may be practiced in ways other than as specifically disclosed, and that all modifications, equivalents, and variations of the present disclosure, which are possible in light of the above teachings and ascertainable to a person of ordinary skill in the art, are specifically included within the scope of the claims. All patents and patent applications disclosed herein are incorporated by reference herein, in their entireties.

What is claimed is:

1. A bedding component, comprising:

a bilayer foam consisting of a high thermal conductivity foam layer and a foam layer underlying the high thermal conductivity foam layer;

a first high thermal conductivity foam layer underlying the bilayer foam comprising at least one of carbon black, graphite, carbon nanotubes, calcium carbonate, and graphene; and a second foam layer underlying the first high thermal conductivity foam layer comprising a continuous foam matrix having a plurality of depressions, with discrete gel portions interspersed throughout the foam matrix in fewer than all of the depressions, wherein the second foam layer exhibits a depth of compression in a standard force compression test with a 13.5 inch platen less than that of an identical foam layer without the depressions and gel portions beyond about 60 lbs of load.

2. The component of claim 1, wherein the gel portions are discs.

3. The component of claim 1, wherein the high thermal conductivity foam layer comprises a gel.

4. The component of claim 2 further including a third layer.

5. The component of claim 4, where the second layer is provided above the first and third layers.

6. The component of claim 4, wherein the first layer is provided above the second layer and the third layer is provided below the second layer.

7. The component of claim 4, wherein the second layer is provided below the first and third layers.

8. The component of claim 4, wherein the third layer comprises at least one of a foam core, a gel foam core, a latex core, an inner spring layer, a layer of individually wrapped coils, an air inflated system, and a liquid system.

* * * * *